US005411343A

United States Patent [19]

Childers

[11] Patent Number: 5,411,343

[45] Date of Patent: May 2, 1995

[54] REDUNDANT MAKE/BREAK INTERCONNECT FOR A PRINT HEAD

[75] Inventor: Winthrop D. Childers, San Diego, Calif.

[73] Assignee: Hewlett-Packard Company, Palo Alto, Calif.

[21] Appl. No.: 73,641

[22] Filed: Jun. 8, 1993

Related U.S. Application Data

[63] Continuation of Ser. No. 923,287, Jul. 31, 1992, abandoned.

[51] Int. Cl.[6] ..... B41J 29/00; B41J 2/01

[52] U.S. Cl. ..... 400/692; 347/50

[58] Field of Search ..... 439/65, 67, 74; 346/76 PH; 400/126, 692

[56] References Cited

U.S. PATENT DOCUMENTS

| | | | |
|---|---|---|---|
| 3,716,907 | 2/1973 | Anderson . | |
| 4,116,517 | 9/1978 | Selvin et al. | 439/329 |
| 4,125,310 | 11/1978 | Reardon, II | 439/67 |
| 4,273,399 | 6/1981 | Myers | 439/74 |
| 4,453,795 | 6/1984 | Moulin | 439/361 |
| 4,602,317 | 7/1986 | Rovynak et al. . | |
| 4,635,073 | 1/1987 | Hanson | 346/1.1 |
| 4,635,080 | 1/1987 | Watanabe . | |
| 4,867,715 | 9/1989 | Roth et al. | 439/876 |
| 4,940,413 | 7/1990 | Childers et al. . | |
| 5,037,311 | 8/1991 | Frankeny et al. | 439/74 |
| 5,092,782 | 3/1992 | Beaman | 439/65 |
| 5,127,839 | 7/1992 | Korsunsky et al. | 439/79 |

FOREIGN PATENT DOCUMENTS

| | | |
|---|---|---|
| 0286258A3 | 10/1988 | European Pat. Off. . |
| 0410656A1 | 1/1991 | European Pat. Off. . |

*Primary Examiner*—Edgar S. Burr
*Assistant Examiner*—John S. Hilten

[57] ABSTRACT

A printer has a printer electrical trace extending to a printer make/break connector, the printer make/break connector including a first printer contact and a second printer contact on the printer electrical trace. A print head cartridge has a cartridge make/break connector, the print head cartridge make/break connector including a first print head cartridge contact and a second print head cartridge contact connected to the same lead within the cartridge. The first printer contact is positioned to register with the first print head cartridge contact and the second printer contact is positioned to register with the second print head cartridge contact when the print head cartridge is removably inserted into the printer. The first printer contact and the second printer contact are spaced apart by a printer contact separation distance sufficiently great that a mechanical failure of the first printer contact and the first print head cartridge contact to engage each other is independent of a mechanical failure of the second printer contact and the second print head cartridge contact to engage each other.

20 Claims, 3 Drawing Sheets

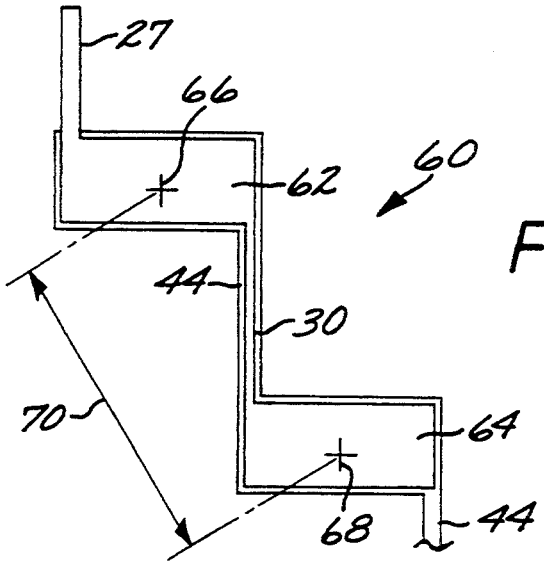
FIG. 4
FIG. 5
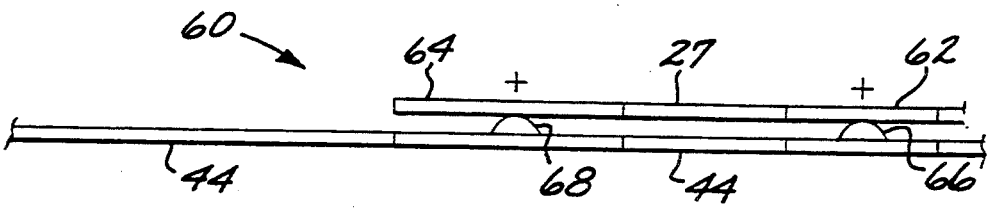
FIG. 6
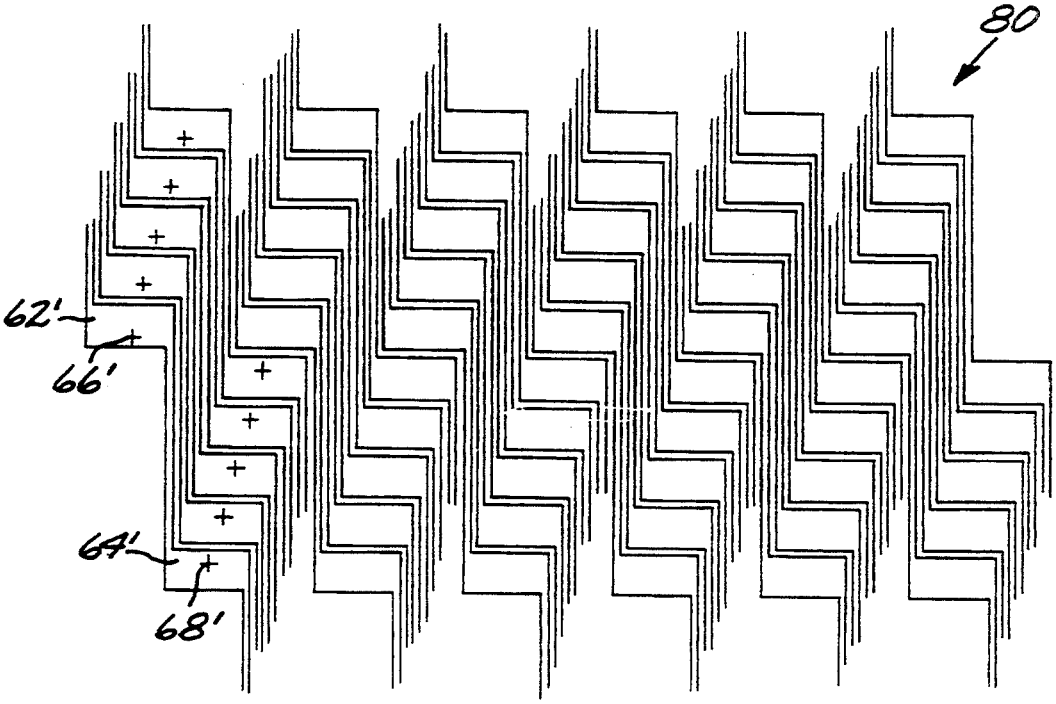

REDUNDANT MAKE/BREAK INTERCONNECT FOR A PRINT HEAD

This application is a continuation of application Ser. No. 07/923,287, filed Jul. 31, 1992, now abandoned.

BACKGROUND OF THE INVENTION

This invention relates to electrical interconnects, and, more particularly, to high reliability electrical make/-break connectors such as those used in thermal ink jet printers with replaceable print cartridges.

Printers are devices that print images onto a printing medium such as a sheet of paper. Printers of many types are available, and are commonly linked to a computer that supplies the content of the images, in the form of text, characters, or figures, that are to be printed.

An ink jet printer forms small droplets of a colorant such as an ink or a dye that are ejected toward the printing medium in the pattern that forms the images. Ink jet printers are fast, producing a high output of print, and quiet, because there is no mechanical impact during formation of the image, other than the deposition of the ink onto the medium.

One type of ink jet printer, the thermal ink jet printer, has a large number of individual colorant-ejection nozzles in a print head, oriented in a facing, but spaced-apart, relationship to the printing medium. There is an electrical resistor adjacent each nozzle, and a pulse of current through the resistor causes ejection of a droplet of colorant from the nozzle toward the medium. The print head moves relative to the surface of the medium, with the nozzles ejecting droplets of colorant under command at the proper times. The droplets strike the medium and then dry to form "dots" of colorant that, when viewed together, create the permanently printed image.

Most thermal ink jet printers are constructed with a permanent printer body and a printing means. The printing mechanism includes, preferably, a disposable print head cartridge containing both the colorant ejector and the colorant supply (or, alternatively, a permanent colorant ejector with a disposable colorant supply). The printer body contains the mechanisms to support the printing medium and the print head cartridge in the proper facing relationship so that printing can be accomplished, the power supply that supplies the electrical current to the ejector resisters, the electronic controllers to achieve particular printing functions, and the interface to the computer. The disposable print head cartridge includes the ejector mechanism, its support, and in some cases the colorant supply. There must be a make/break interconnect between the printer body and the disposable print head cartridge, which is a connection that is readily made, is "temporary" in the sense that it is maintained until the cartridge is to be replaced, and allows easy disconnection and replacement. The present invention is concerned with such a make/break interconnect.

By experience with commercial thermal ink jet printers, the make/break interconnect has been found to be one of the portions of the system most susceptible to reduced reliability in service. The work leading to the present invention has determined that the reduced reliability may be traced to two principal causes. First, the electrical interconnections may be formed slightly irregularly as a result of normal manufacturing tolerances. Even relatively small irregularities in height and position of the interconnections may prevent a contact from being achieved on all of the lines of each interconnect. The result is that manufacturing tolerances must be reduced, with resulting increased manufacturing cost and increased rejection rates. Quality control procedures must be more extensive than would otherwise be required. Second, the electrical interconnections may become dirty or oxidized during storage prior to installation, or even after installation. The person installing the print head cartridge or using the thermal ink jet printer must take extra care to clean the interconnections prior to use, or at intervals during use. This requirement is burdensome, because most users are not technically qualified and may actually damage the interconnection during the cleaning process. The alignment and dirt/contamination problems become more troublesome as the number of required connections increases, as is the trend in modern printers.

There is therefore an ongoing need for an improved approach to a make/break interconnection for ink jet printers and other devices that is more tolerant of misalignment and other consequences of normal manufacturing tolerances, and also is less susceptible to reduced reliability due to the presence of dirt or contamination. The present invention fulfills this need, and further provides related advantages.

SUMMARY OF THE INVENTION

The present invention provides a host device, such as a printer, and a removable component, such as a print head cartridge, and their interconnection structure having increased reliability. The connector is less susceptible to inoperability due to variations arising from manufacturing variations, such as variations in connector structure and misalignment of connector components. The connector is also more tolerant of dirt and contamination that might otherwise prevent operation of the connector.

Generally in accordance with the invention, a host device and removable component comprise a host device having a host device electrical connector trace and a removable component requiring electrical contact to the host device. Means for electrically connecting the host device and the removable component includes a first host device contact and a second host device contact on the host device electrical connector trace, and a first removable component contact and a second removable component contact on the removable component. The first removable component contact and the second removable component contact are positioned to engage the first host device contact and the second host device contact, respectively, when the removable component is removably inserted into the host device.

More specifically, and in accordance with one preferred embodiment of the invention, a printer and removable print head cartridge comprise a printer having a printer electrical connector trace, and a print head cartridge. Means for electrically connecting the printer and the print head cartridge includes a first printer contact and a second printer contact on the printer electrical connector trace, and a first print head cartridge contact and a second print head cartridge contact on the print head cartridge. The first print head cartridge contact and the second print head cartridge contact are positioned to engage the first printer contact and the second printer contact, respectively, when the print head cartridge is removably inserted into the printer. In the usual case, there are a plurality of such traces, each with two contacts per trace.

In one form, the first printer contact and the second printer contact are spaced apart by a printer contact separation distance sufficiently great that a mechanical failure of the first printer contact and the first print head cartridge contact to engage each other is Independent of a mechanical failure of the second printer contact and the second print head cartridge contact to engage each other. The printer contact separation distance is preferably at least about 5 millimeters. The result of this separation of the two contacts is a reduced likelihood that a manufacturing variation in the height of one of the contacts, which prevents formation of a good engagement for that pair of contacts, will not prevent engagement of the other pair of contacts. Also, dirt or other particles that prevent engagement at one of the contacts are unlikely to bridge over to the other contact.

Further Improved reliability is achieved by positioning the second printer contact asymmetrically with respect to the second print head cartridge contact, relative to the positioning of the positioning of the first printer contact with respect to the second print head cartridge contact. The result of this asymmetric positioning is a reduced likelihood that a manufacturing variation in the lateral position of one of the contacts will be sufficient to prevent engagement of that pair of contacts. The total area required for all of the interconnects is reduced by using asymmetric positioning, an important consideration as the number of interconnect contacts becomes large.

Thus, the approach of the invention is less susceptible to reduced reliability due to structure variations resulting from normal manufacturing tolerances than is the conventional approach. A printer using the present approach is also less likely to fail due to dirt contamination of a contact pair, because the other contact pair is still available. Contamination of both contact pairs is unlikely.

The present invention provides an important advance in the art of make/break connections, and in particular such interconnections used in ink jet printer systems. Other features and advantages of the invention will be apparent from the following more detailed description of the preferred embodiments, taken in conjunction with the accompanying drawings, which illustrate, by way of examples, the principles of the invention.

BRIEF DESCRIPTION OF THE DRAWINGS

FIG. 4 is a plan view of a print head cartridge electrical connector trace superimposed over a printer electrical connector trace, as they are positioned in service;

FIG. 5 is an elevational view of the print head cartridge electrical connector trace and printer electrical connector trace of FIG. 4; and FIG. 6 is a plan view of a plurality of superimposed printer electrical connector traces and print head cartridge electrical connector traces.

DETAILED DESCRIPTION OF THE PREFERRED EMBODIMENT

Figure 1:
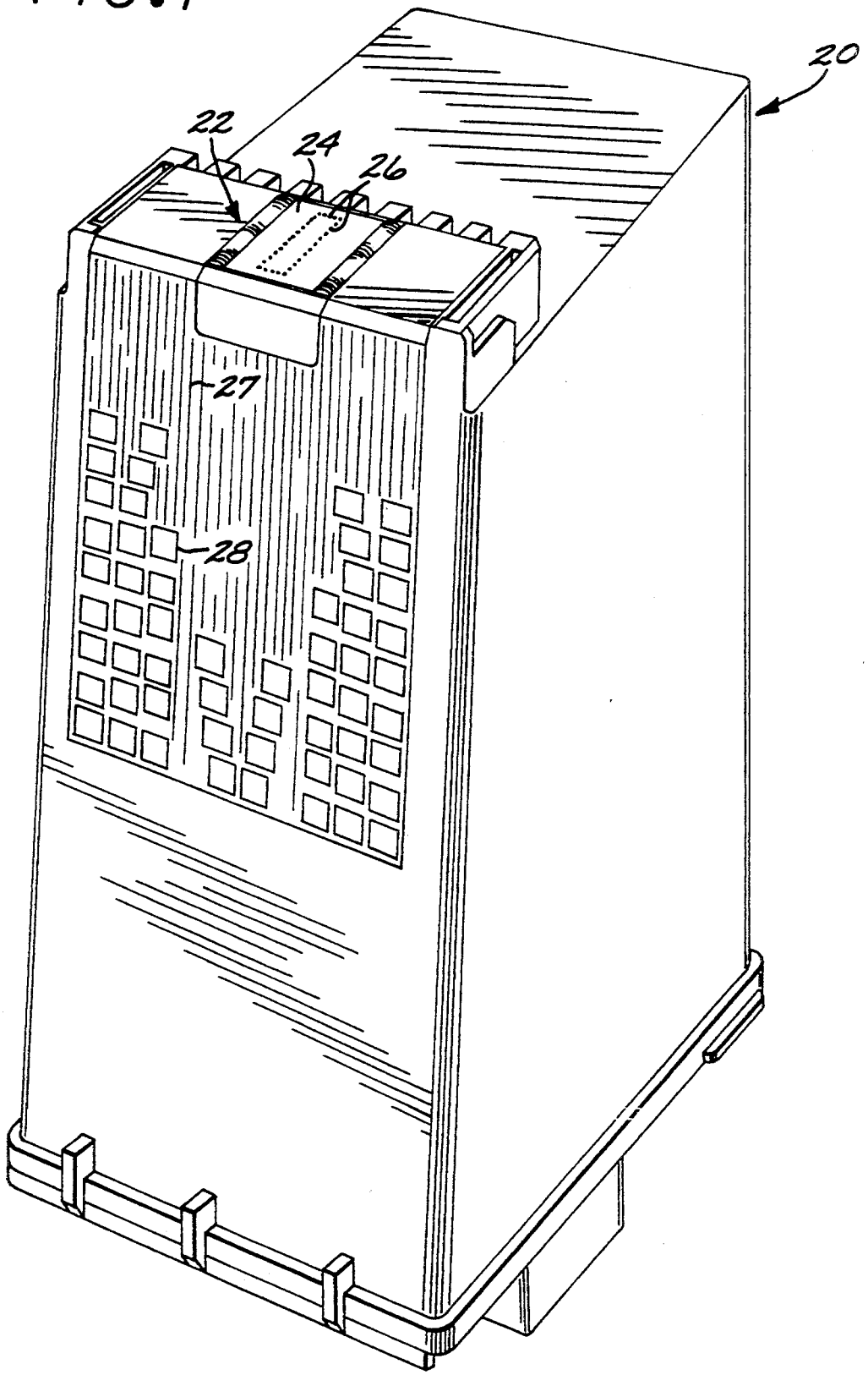
FIG. 1 is a perspective view of a thermal ink jet print head cartridge.

The approach of the present invention is preferably used in conjunction with a thermal ink jet printer, although it is not so restricted. A thermal ink Jet print head cartridge 20, used to eject droplets of colorant toward a print medium in a precisely controlled manner, is illustrated in FIG. 1. The print head cartridge 20 includes an ejector 22 having a nozzle plate 24. The nozzle plate 24 has a plurality of nozzles 26 therein. Droplets of colorant are ejected from the individual nozzles 26. (As used herein, the term "colorant" means generally a fluid that is deposited upon a printing medium to produce images, which typically includes inks and dyes, and is not restricted to any narrow sense of that term as may be found in the printing arts.)

Droplets of colorant are ejected from the nozzles 26 by passing an electrical current through a resistor (not shown) lying below each nozzle 26. Electrical current is conveyed to the respective electrical resistors through a plurality of cartridge traces 27, one for each nozzle 26. (For large numbers of nozzles, the total number of traces may be reduced by using a multiplexed system to address each of the nozzles. In such a system, some leads provide address and demultiplexing information, and other leads conduct current. In such a system, the adverse consequences of losing the signal on a trace are even greater than in the system of dedicated current-carrying traces.) External electrical connection to the traces and thence to the resistors is supplied through a set of print head cartridge electrical contacts 28. In the illustrated design, the print head cartridge electrical contacts 28 are placed on one of the side walls of the cartridge 20, so that they can be connected to respective contacts on the printer body, as will be discussed subsequently.

Figure 2:
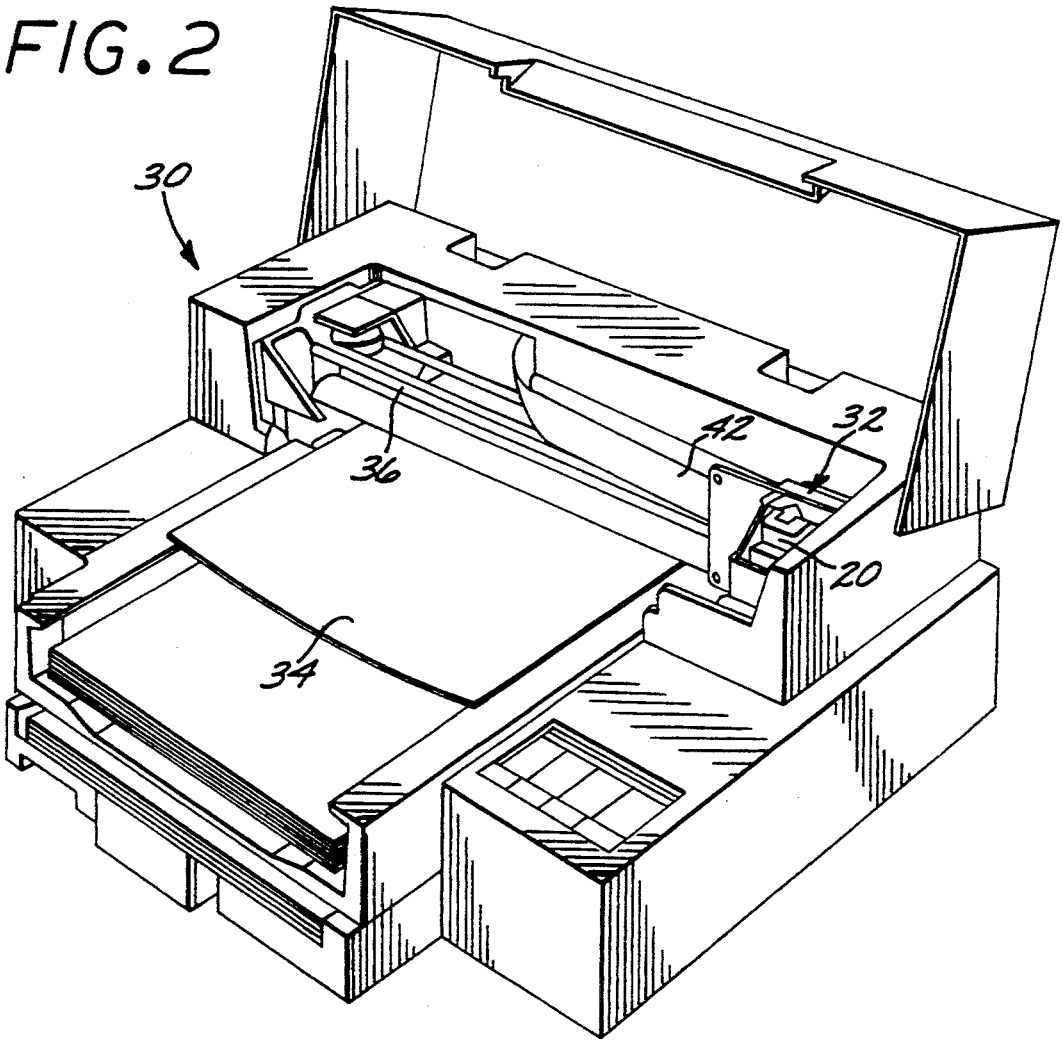
FIG. 2 is a perspective view of an ink jet printer body.

FIG. 2 illustrates an ink jet printer 30, which can utilize print head cartridges 20 of the type just discussed, and to which the print head cartridge 20 of FIG. 1 is releasably interconnected with a make/break connection. The printer 30 supports the print head cartridge 20 in a carriage 32, in a generally facing but spaced apart relationship to a printing medium 34. The carriage 32 moves back and forth over the printing medium 34 on a rail 36.

Figure 3:
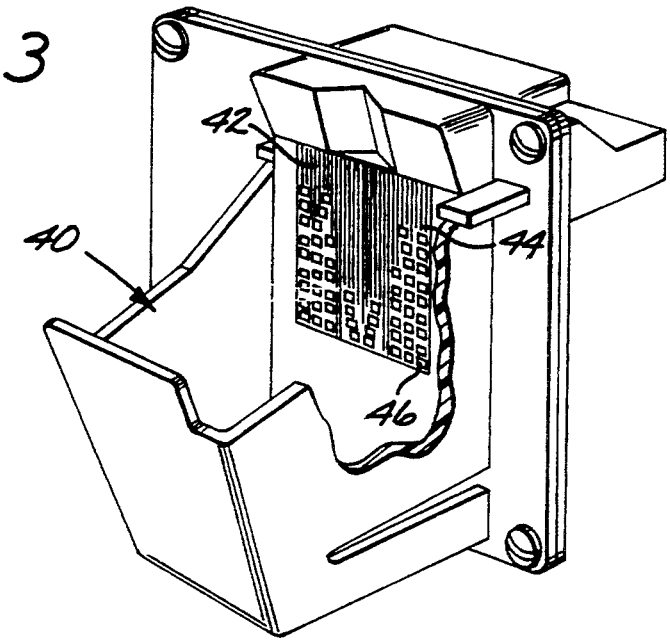
FIG. 3 is a perspective view of a print head cartridge support.

A portion of the carriage 32 is illustrated in greater detail in FIG. 3. The carriage 32 includes a pocket 40 into which the print head cartridge 20 is received in an inverted position, relative to the view of FIG. 1. A cable 42, having a plurality of individual printer electrical connector traces 44, runs from a power supply (not shown) in the printer 30 down the side wall of the pocket 40. The traces 44 have printer electrical contacts 46 at and adjacent to their ends, as will be subsequently described in more detail. The traces 44 extend to a location where the printer electrical contacts 46 may be releasably connected with a make/break connection to the corresponding print head electrical contacts 28 of the cartridge 20, when the cartridge 20 is inserted into the pocket 40.

FIG. 4 illustrates the details of an interconnect structure 60 of the present invention in plan view, with the contacts superimposed as they are when the connection is made. FIG. 5 illustrates the structure 60 in elevational view.

The print head cartridge electrical contact, generally identified as numeral 28 in FIG. 1, includes a first print head cartridge contact 62 and a second print head cartridge contact 64 thereon. In the illustrated case, each print head cartridge contact 62 and 64 is a flat metallic pad on the trace 27. These contacts 62 and 64 are substantially flush with the external surface of the cartridge 20. The contacts 62 and 64 are positioned at different locations along the trace 27 that extends to the electrical resistors of the respective nozzles 26.

The printer electrical connector trace 44 has a first printer contact 66 and a second printer contact 68 thereon. The contacts 66 and 68 are positioned such that when the print head cartridge 20 is assembled into the pocket 40, the first printer contact 66 registers with the first print head cartridge contact 62 and the second printer contact 68 registers with the second print head cartridge contact 64. In the illustrated embodiment, the printer contacts 66 and 68 are metallic bumps supported on widened portions of the printer electrical connector trace 44. (In the plan view of FIG. 4, the positions of the printer contacts 66 and 68, which are out of view below the print head cartridge contacts 62 and 64, are indicated by plus signs (+) and are labelled with the respective numerals.) Alternatively, the metallic bumps could be on the contacts 62 and 64 of the trace 27, with the flat metallic pads on the trace 44.

The providing of two pairs of contacts (62, 66) and (64, 68) for each electrical interconnect reduces the likelihood of a failure of that trace connector to achieve a good electrical connection when the print head cartridge 20 is connected to the printer 30. Impairment (due to dirt, particles, lint, or other foreign matter) or failure to achieve a mechanical engagement (due to geometrical reasons, discussed below) of one of the pairs of contacts has a relatively low probability, and as a result impairment of both pairs of contacts has a much lower probability, if the probabilities of impairment are independent.

To ensure such independence, the printer contacts 66 and 68 are separated by a printer contact separation distance 70, which is preferably at least about 5 millimeters. Separation of the printer contacts 66 and 68 (and thence the registered contacts 62 and 64) ensures that the likelihoods of failure of two failed contact pairs are independent in two ways. First, it is unlikely that the same piece of dirt, lint, or other foreign matter would cover both pairs of contacts (62, 66) and (64, 68) simultaneously. Second, the bumped contacts 66 and 68 may be prepared by techniques such as dimpling of plastic having metallic coatings thereon or electroplating that cannot be controlled precisely, so that there may be a variation in the heights of the bumps 66 and 68. (In the dimpling approach, a metallic trace is deposited upon a piece of plastic, and a tool is pushed upwardly from below the plastic to cause the metallic trace to dimple upwardly.)

Normally, all of the bumps in an array are of about the same height when formed, but the occasional irregularity may occur. If the bumps 66 and 68, or bumps of adjacent sets of traces are too close together, then an increase in the height of one of the bumps may prevent others of the contact pairs from making engagement when the electrical contact is to be made. By spacing the printer contacts 66 and 68 sufficiently far apart, the structure supporting the cartridge contacts 62 and 64 can relax so that the high bump on one of the contacts does not prevent the other contact pair from engaging, and does not prevent at least one of the pairs of contacts on adjacent traces from engaging. Thus, the approach of the invention of providing two sets of contact pairs, and spacing them sufficiently far apart, is operable with reduced manufacturing tolerances. That is, because the structure of the invention is tolerant of variations in bump height without losing contact, it is not necessary to maintain the bump heights of all printer contacts as stringently controlled as is necessary in conventional approaches using only a single contact pair.

FIG. 6 illustrates a general array of contacts 80 formed from the plurality of electrical traces usually present in a printer and print head cartridge, and as shown generally in FIGS 1–3. One set of the contacts 62', 64', 66', and 68' is labelled. This arrangement of contacts provides a maximum amount of contact area (and therefore misalignment tolerance) in a minimum footprint or total area occupied.

FIG. 6 also illustrates an alternative asymmetric arrangement of the printer contacts 66' and 68'. This asymmetry may be seen by comparing the positions of the plus (+) signs representing the printer contacts 66 and 68 of FIG. 4 with the positions of the printer contacts 66' and 68' of FIG. 6. In the symmetric case of FIG. 4, the printer contacts 66 and 68 are located at the same relative location with respect to the print head cartridge contacts 62 and 64. In the asymmetric case of FIG. 6, the printer contacts 66' and 68' are located differently with respect to the print head cartridge contacts 62' and 64'.

In the illustrated symmetric arrangement of FIG. 4, the first printer contact 66 is located close to the lower edge of the first print head cartridge contact 62, and the second printer contact 68 is located close to the lower edge of the second print head cartridge contact 64. In the illustrated asymmetric arrangement of FIG. 6, the first printer contact 66' is located close to the lower edge of the print head cartridge contact 62'. The second printer contact 68' is located close to the upper edge of the second print head cartridge contact 64'. The use of the asymmetric arrangement of FIG. 6 permits the required interconnection to be made with an even greater degree of lateral displacement of the first and second printer contacts 66' and 68' than possible in the symmetric arrangement of FIG. 4. That is, the asymmetric arrangement is more forgiving of lateral displacements of the first or second printer contacts 66' and 68' that might occur because of relaxed manufacturing tolerances. The ability to relax lateral position manufacturing tolerances (as well as bump height tolerances, discussed previously) is an important advantage of the present invention, because the tighter the tolerances, the more expensive it is to maintain those tolerances.

The asymmetric approach of FIG. 6 may be employed in another way. As the number of trace pairs and required contacts for a device increases, the total surface area available for the contacts may limit the use of conventional contact techniques. If the same manufacturing tolerance is maintained for lateral position of the printer contacts 66 and 68 (rather than a relaxation of that tolerance, as described previously), then the contact pads 62 and 64 may be made smaller in lateral dimensions without sacrificing reliability of the connection. Making the print head cartridge contacts 62 and 64 smaller permits more contacts to be placed within a predefined total surface area.

The present invention provides an improvement in reliability for electrical devices involving make/break contacts, such as the printer and print head cartridge discussed here. A calculation of reliability has been performed to estimate the degree of improvement available with the present invention. From actual experience, an ink jet printer having 50 nozzles and thence 50 contacts to be electrically interconnected, and using a conventional approach of a single pair of contacts for each trace, has a total interconnect reliability of about 95 percent. Assuming that the same degree of per-contact reliability is achieved, if the number of traces to be contacted is increased to 400, the reliability of the interconnect would fall to about 67 percent. On the other hand, if there are two contact pairs on each trace, separated sufficiently so that mechanical contact failures are independent of each other, the reliability of the 400 nozzle systems increases to about 99.96 percent.

The present approach runs contrary to the usual trend in printer/cartridge interconnect design. As the number of nozzles and required interconnects increases, with the interconnect space remaining approximately constant, the usual approach dictates reducing the size of contacts and maintaining a single contact per trace. The result is reduced reliability and reduced manufacturing tolerance, and thence higher cost. In the present approach, the number of contacts per trace is doubled, leading to improved reliability. Careful design of the contact arrangement leads to increased manufacturing tolerances and likelihood of making good contacts to each trace when the cartridge is inserted into the printer.

Thus, the present invention provides an important advance in the art of make/break interconnects. Although a particular embodiment of the invention has been described in detail for purposes of illustration, various modifications may be made without departing from the spirit and scope of the invention. Accordingly, the invention is not to be limited except as by the appended claims.

What is claimed is:

1. A printer and removable print head cartridge, comprising:

a printer having a printer electrical connector trace, the printer electrical connector trace comprising an electrically common conductor;

a print head cartridge that requires an electrical interconnect to the printer, the print head cartridge having a print head electrical connector trace, the print head electrical connector trace comprising an electrically common conductor; and means for electrically connecting the printer and the print head cartridge, the means for connecting including a first printer contact and a second printer contact on the printer electrical connector trace, the first printer contact and the second printer contact being electrically common, and a first print head cartridge contact and a second print head cartridge contact on the print head, the first print head cartridge contact and the second print head cartridge contact being electrically common through, and arranged serially along, the print head electrical connector trace with an inter-contact electrically conductive trace segment extending between the first print head cartridge contact and the second print head cartridge contact, the first print head cartridge contact and the second print head cartridge contact being positioned to engage the first printer contact and the second printer contact, respectively, when the print head cartridge is removably inserted into the printer, without any intervening conductive member between the first and second printer contacts on the one hand and the first and second print head cartridge contacts on the other hand.

2. The printer and removable print head cartridge of claim 1, wherein the length of the inter-contact electrically conductive trace segment is such that the first printer contact and the second printer contact are spaced apart from each other by a printer contact separation distance sufficiently great that a mechanical failure of the first printer contact and the first print head cartridge contact to engage each other is independent of a mechanical failure of the second printer contact and the second print head cartridge contact to engage each other.

3. The printer and removable print head cartridge of claim 1, wherein the length of the inter-contact electrically conductive trace segment is such that the first printer contact and the second printer contact are spaced apart from each other by a printer contact separation distance of at least about 5 millimeters.

4. The printer and removable print head cartridge of claim 1, wherein the first printer contact is a dimpled bump formed on a piece of plastic having a metallic coating thereon, and the first print head cartridge contact is a metallic pad.

5. The printer and removable print head cartridge of claim 1, wherein one of the first printer contact and the first print head cartridge contact is a metallic bump, and the other is a metallic pad.

6. The printer and removable print head cartridge of claim 1, wherein the first printer contact is a metallic bump, and the first print head cartridge contact is a metallic pad.

7. The printer and removable print head cartridge of claim 1, wherein one of the first printer contact and the first print head cartridge contact is a dimpled bump formed on a piece of plastic having a metallic coating thereon.

8. A printer and removable print head cartridge, comprising:

a printer having a printer electrical connector trace, and printer electrical connector trace comprising an electrically common conductor;

a print head cartridge that requires an electrical interconnect to the printer; and means for electrically connecting the printer and the print head cartridge, the means for connecting including a first printer contact and a second printer contact on the printer electrical connector trace, the first printer contact and the second printer contact being electrically common, and a first print head cartridge contact and a second print head cartridge contact on the print head, the first print head cartridge contact and the second print head cartridge contact being electrically common, the first print head cartridge contact and the second print head cartridge contact being positioned to engage the first printer contact and the second printer contact, respectively, when the print head cartridge is removably inserted into the printer, without any intervening conductive member between the first and second printer contacts on the one hand and the first and second print head cartridge contacts on the other hand, and wherein the second printer contact is positioned asymmetrically with respect to the second print head cartridge contact, relative to the positioning of the first printer contact with respect to the first print head cartridge contact.

9. A printer and removable print head cartridge, comprising:

printer having a printer electrical connector means for making electrical connection, the printer electrical connector means including at least one printer electrical connector trace, the trace comprising an electrically common conductor;

a print head cartridge having an ink ejector, and a print head cartridge electrical connector means for making electrical connection to the ink ejector, the print head cartridge electrical connector means including a print head cartridge trace in electrical communication with the ink ejector; and means for electrically connecting the printer electrical connector means and the print head cartridge electrical connector means in a disconnectable, make-break fashion, the means for connecting including a first printer contact and a second printer contact on each of the printer electrical connector traces, the first printer contact and the second printer contact being electrically common and arranged serially along the respective printer electrical connector traces, and a first print head cartridge contact and a second print head cartridge contact, the first print head cartridge contact and the second print head cartridge contact being electrically common, the respective first print head cartridge contact and the second print head cartridge contact being positioned to engage the first printer contact and the second printer contact, respectively, when the print head cartridge is removably inserted into the printer, without any intervening conductive member between the first and second printer contacts on the one hand and the first and second print head cartridge contacts on the other hand.

10. A printer and removable print head cartridge, comprising:

a printer having a printer electrical trace extending to a printer make/break connector, the trace comprising an electrically common conductor, the printer make/break connector including a first printer contact and a second printer contact on the printer electrical trace, the first printer contact and the second printer contact being electrically common; and a print head cartridge having a print head cartridge make/break connector, the print head cartridge make/break connector including a first print head cartridge contact and a second print head cartridge contact, the first print head cartridge contact and the second print head cartridge contact being electrically common, the first printer contact being positioned to register with the first print head cartridge contact and the second printer contact being positioned to register with the second print head cartridge contact when the print head cartridge is removably inserted into the printer, without any intervening conductive member between the first and second printer contacts on the one hand and the first and second print head cartridge contacts on the other hand, and the printer make/break connector including an inter-contact electrically conductive trace segment extending between the first printer contact and the second printer contact, the length of the inter-contact electrically conductive trace segment being sufficiently great that a mechanical failure of the first printer contact and the first print head cartridge contact to engage each other is independent of a mechanical failure of the second printer contact and the second print head cartridge contact to engage each other.

11. The printer and removable print head cartridge of claim 10, wherein the printer contact separation distance is at least about 5 millimeters.

12. The printer and removable print head cartridge of claim 10, wherein the second printer contact is positioned asymmetrically with respect to the second print head cartridge contact, relative to the positioning of the first printer contact with respect to the first print head cartridge contact.

13. The printer and removable print head cartridge of claim 10, wherein one of the first printer contact and the first print head cartridge contact is a metallic bump, and the other is a metallic pad.

14. A host device and removable component, comprising:

a host device having a host device electrical connector trace, the trace comprising an electrically common conductor;

a removable component having a removable component electrical connector trace comprising an electrically common conductor; and means for electrically connecting the host device and the removable component, the means for connecting including a first host device contact and a second host device contact on the host device electrical connector trace, the first host device contact and the second host device contact being electrically common, and a first removable component contact and a second removable component contact on the removable component, the first removable component contact and the second removable component contact being electrically common and disposed serially along the length of the removable component electrical connector trace, the removable component electrical connector trace including an electrically conductive trace segment extending between the first removable component contact and the second removable component contact, the first removable component contact and the second removable component contact being positioned to engage the first host device contact and the second host device contact, respectively, when the removable component is removably inserted into the host device, without any intervening conductive member between the first and second removable component contacts on the one hand and the first and second host device contacts on the other hand.

15. The host device and removable component of claim 14, wherein the length of the removable component electrically conductive trace segment is sufficiently great that a mechanical failure of the first host device contact and the first removable component contact to engage each other is independent of a mechanical failure of the second host device contact and the second removable component contact to engage each other.

16. The host device and removable component of claim 15, wherein the host device contact separation distance is at least about 5 millimeters.

17. The host device and removable component of claim 14, wherein the second host device contact is positioned asymmetrically with respect to the second removable component contact, relative to the positioning of the first host device contact with respect to the first removable component contact.

18. A removable print head cartridge for use with a printer having an electrically connected first printer contact and second printer contact, the cartridge comprising:

a print head cartridge; and a first print head cartridge contact and a second print head cartridge contact on the print head cartridge, the first and second print head cartridge contacts being serially connected to a single electrically continuous lead within the print head cartridge with an electrically conductive inter-contact trace segment extending between the first print head cartridge contact and the second print head cartridge contact, the first print head cartridge contact and the second print head cartridge contact being electrically common, the first print head cartridge contact and the second print head cartridge contact being positioned to engage the first printer contact and the second printer contact, respectively, when the print head cartridge is removably inserted into the printer, without any intervening conductive member between the first and second printer contacts on the one hand and the first and second print head cartridge contacts on the other hand.

19. The removable print head cartridge of claim 18, wherein the length of the electrically conductive inter-contact trace segment is sufficiently great that a mechanical failure of the first printer contact and the first print head cartridge contact to engage each other is independent of a mechanical failure of the second printer contact and the second print head cartridge contact to engage each other.

20. The removable print head cartridge of claim 19, wherein the cartridge contact separation distance is at least about 5 millimeters.

* * * * *